United States Patent [19]

Cherian

[11] 4,043,656

[45] Aug. 23, 1977

[54] TRANSPARENCY COPYING MACHINE

[75] Inventor: Abraham Cherian, Webster, N.Y.

[73] Assignee: Xerox Corporation, Stamford, Conn.

[21] Appl. No.: 663,389

[22] Filed: Mar. 3, 1976

[51] Int. Cl.[2] ..... G03G 15/00

[52] U.S. Cl. ..... 355/3 R; 355/4; 355/11

[58] Field of Search ..... 355/3 R, 4, 11; 353/37

[56] References Cited

U.S. PATENT DOCUMENTS

| | | | |
|---|---|---|---|
| 3,051,044 | 8/1962 | McNany | 355/11 X |
| 3,439,983 | 4/1969 | Blow | 355/11 X |

*Primary Examiner*—Richard L. Moses

*Attorney, Agent, or Firm*—J. J. Ralabate; C. A. Green; H. Fleischer

[57] ABSTRACT

An electrophotographic printing machine in which a transparency or an opaque original document is reproduced. In reproducing a transparency, a mirror is pivoted from a position remote from the light image path into the path of the transparency light image. When an opaque original document is being reproduced, the mirror is pivoted to the position remote from the light image path.

13 Claims, 2 Drawing Figures

TRANSPARENCY COPYING MACHINE

BACKGROUND OF THE INVENTION

This invention generally relates to an electrophotographic printing machine, and more particularly concerns a printing machine arranged to reproduce transparencies or opaque original documents.

The process of electrophotographic printing comprises exposing a charged photoconductive member to a light image of an original document being reproduced. The irradiated areas of the photoconductive surface are discharged to record thereon an electrostatic latent image corresponding to the original document. A development system moves a developer mix of carrier granules and toner particles into contact with the photoconductive surface. The toner particles are attracted electrostatically from the carrier granules to the latent image forming a toner powder image thereon. Thereafter, the toner powder image is transferred to a sheet of support material. After transferring the toner powder image to the sheet of support material, a fusing device permanently affixes the toner powder image thereto. The foregoing briefly describes the basic operation of an electrophotographic printing machine. This concept has mechanized by a wide variety of machines. However, in most instances, the prior art machines have various types of improvements which provide greater copy clarity. These improvements are all of a nature such that specific problems have been resolved. In addition, special purpose electrophotographic printing machines have been developed and are in wide commercial use. For example, electrophotographic printing machines are presently commercially available for reproducing microfilm. Machines of this type are described in U.S. Pat. No. 3,424,525 issued to Towers et al., in 1969; U.S. Pat. No. 3,542,468 issued to Blow, Jr., in 1970; and U.S. Pat. No. 3,547,533 issued to Stokes et al., in 1970. In general, a microfilm reproducing machine produces an enlarged copy of a microfilm original. However, it has been found to be difficult to produce copies having pictorial quality. Moreover, high quality reproduction of color slides has only been recently achieved. This is described in co-pending application Ser. No. 540,617 filed in 1975. As described therein, a light image of a color transparency is projected onto a mirror. The mirror reflects the light image in a downwardly direction through a screen and field lens onto the charged portion of the photoconductive surface. This light image is filtered to produce a single color electrostatic latent image on the photoconductive surface. Successive single color electrostatic latent images are recorded on the photoconductive surface and developed with the appropriately colored toner particles. These toner powder images are transferred to a sheet of support material in superimposed registration with one another. This multilayered toner powder image is then permanently affixed to the sheet of support material forming a copy of the color slide being reproduced. However, a machine of this type requires numerous manual manipulations in order to convert it from reproducing opaque copies to one which reproduces slides. For example, the platen cover must be moved away and a mirror positioned in the path of the transparency light image to direct the light image onto the charged portions of the photoconductor member. No simple structure has been developed for readily achieving the foregoing. This increases the complexity of using a printing machine employed to reproduce color slides.

Accordingly, it is a primary object of the present invention to improve an electrophotographic printing machine arranged to reproduce color transparencies by simplifying the conversion thereof from the opaque copying mode to the transparency copying mode.

SUMMARY OF THE INVENTION

Briefly stated, and in accordance with the present invention, there is provided an electrophotographic printing machine for reproducing a transparency or an opaque original document.

Pursuant to the features of the present invention, the printing machine includes a receiving member and a photoconductive member. Means are provided for charging at least a portion of the photoconductive member to a substantially uniform level. Projecting means transmit a light image of the transparency to movable directing means. The directing means transmits the light image through the receiving member and modulating means onto the charged portion of the photoconductive member. The directing means is movable from a first position remote from the path of the transparency light image to a second position in the path of the transparency light image. During the reproduction of an opaque original document, the directing means is in the first position. When a transparency is being reproduced, the directing means moves to the second position.

BRIEF DESCRIPTION OF THE DRAWINGS

Other objects and advantages of the present invention will become apparent upon reading the following detailed description and upon reference to the drawings, in which.

Figure 1:
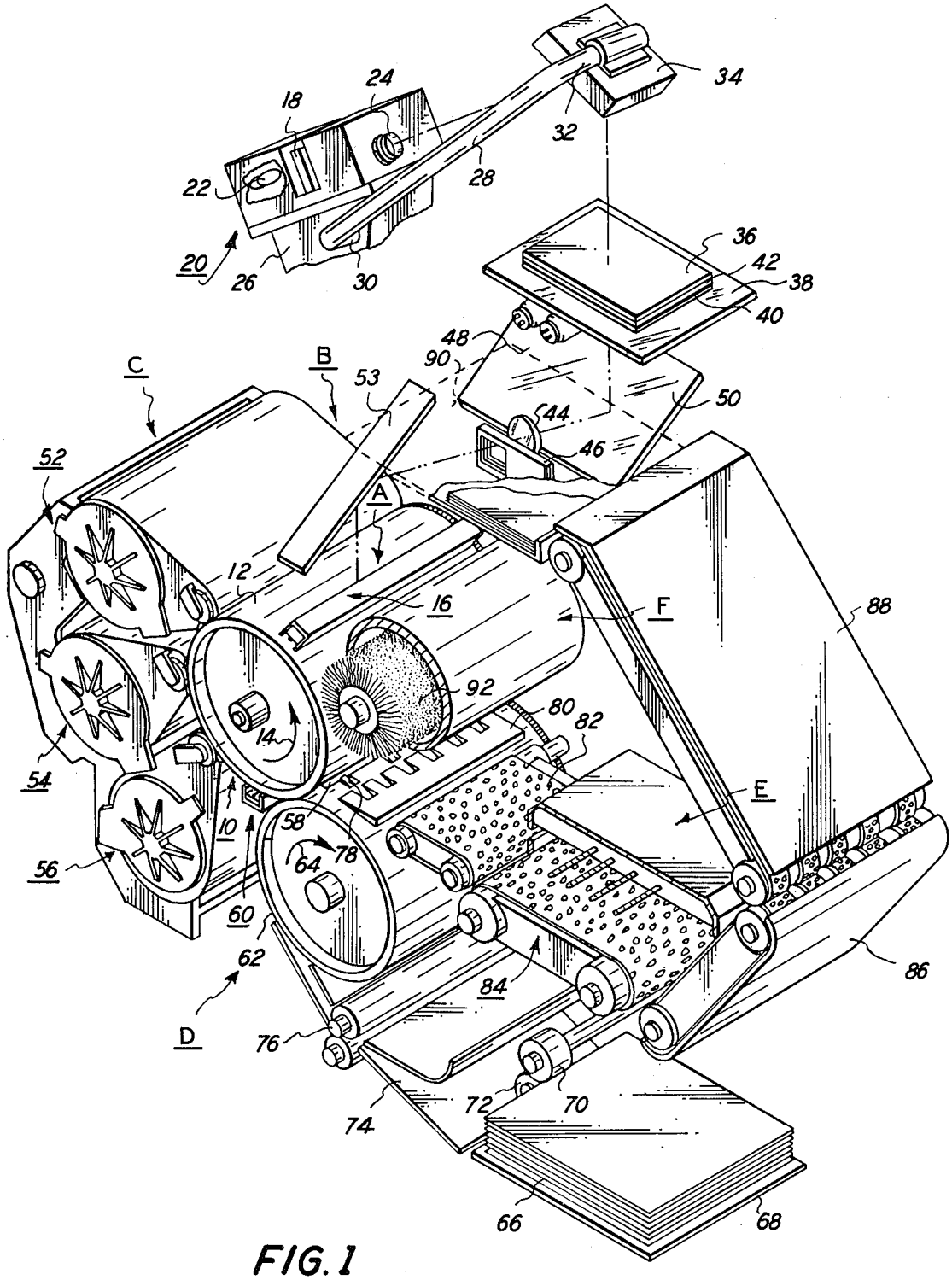
FIG. 1 is a schematic perspective view of an electrophotographic printing machine incorporating the features of the present invention therein.

While the present invention will hereinafter be described in connection with a preferred embodiment thereof, it is understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of an electrophotographic printing machine incorporating the features of the present invention therein, continued reference is had to the drawings. In the drawings, like reference numerals have been used throughout to designate like elements. Although the electrophotographic printing machine of the present invention is particularly well adapted for reproducing color transparencies or colored opaque original documents, it should become evident from the following discussion that it is equally well suited for use in a wide variey of applications such as producing black and white copies from black and white transparencies or from black and white opaque original documents and is not necessarily limited to the particular embodiment shown herein.

An illustrative schematic of the electrophotographic printing machine is shown in FIG. 1. As depicted therein, the electrophotographic printing machine utilizes a photoconductive member having a drum 10 mounted rotatably within the machine frame (not shown) with photoconductive surface 12 secured thereto and entrained thereabout. Preferably, photoconductive surface 12 is made from a suitable panchromatic selenium alloy such as is described in U.S. Pat. No. 3,655,377 issued to Sechak in 1972.

As drum 10 rotates in the direction of arrow 14, photoconductive surface 12 passes through a series of processing stations located about the periphery thereof. Drum 10 is rotated at a constant angular velocity so that the proper sequencing of events may occur at each of the processing stations. Timing for each event is achieved by a signal generator (not shown) operatively associated with drum 10. The signal generator develops electrical pulses which are processed by the machine logic so that each processing station is activated at the appropriate time during the rotation of drum 10.

Initially, drum 10 rotates through charging station A. At charging station A, a corona generating device, indicated generally by the reference numeral 16, charges at least a portion of photoconductive surface 12 to a relatively high, substantially uniform level. A suitable corona generating device is described in U.S. Pat. No. 3,875,407 issued to Hayne in 1975.

After photoconductive surface 12 is charged to a substantially uniform level, drum 10 rotates the charged portion thereof to exposure station B. At exposure station B, a colored filtered light image of color transparency 18, as exemplified by a 35MM slide, is projected onto the charged portion of photoconductive surface 12. Color transparency 18 is positioned in slide projector 20. Slide projector 20 includes a light source 22 adapted to illuminate transparency 18. In addition, slide projector 20 comprises a lens 24 having an adjustable focus to produce an enlarged or magnified image of color transparency 18. Slide projector 20 is mounted on a portion of printing machine frame, designated by the reference numeral 26. A bar 28 has end portion 30 mounted pivotably on frame 26. End 32 of bar 28 is secured rotatably to mirror 34. In this way, bar 28 may be pivoted relative to frame 26 so as to move mirror 34 out of the path of the transparency light image when an opaque original document is being reproduced by the electrophotographic printing machine. Contrawise, when a transparency is being reproduced, bar 28 is pivoted to position mirror 34 in the path of the transparency light image. Thus, the light image of transparency 18 projected from slide projector 20, is transmitted to mirror 34 which directs it through Fresnel lens 36. Mirror 34 is mounted rotatably on bar 28 so as to be capable of directing the light image in the desired direction, i.e., transmitted through Fresnel lens 36. Interposed between Fresnel lens 36 and transparent platen 38 is an optional opaque sheet 40 having an aperture therein, i.e., a picture frame or informational frame, which may be considered a composition frame. Composition frame 40 defines an opaque border extending outwardly from the color transparency image. Frame 40 may have indicia inscribed thereon. A screen 42 may be disposed beneath Fresnel lens 36, i.e., interposed between Fresnel lens 36 and composition frame 40. Screen 42 modulates the color transparency light image forming a half-tone light image. A scanning system is disposed beneath platen 38 and includes a moving lens system designated generally by the reference numeral 34, and a color filter mechanism, shown generally at 46. Lamps 48 move in a timed relationship with lens 44 and filter mechanism 46 to scan and illuminate successive incremental areas of composition frame 40 which may be optionally placed on platen 38. In this manner, a half tone light image of the color transparency may be combined with a light image of the composition frame to form a combined image. This combined image is transmitted onto the charged portion of photoconductive surface 12 selectively dissipating the charge thereon to record an electrostatic latent image.

The platen cover (not shown) must be pivoted to the open position permitting arm 28 to pivot so as to locate mirror 34 in the path of the transparency light image. Contrawise, when an opaque original document is being reproduced, arm 28 pivots to a position remote from the path of the transparency light image permitting the platen cover to be closed.

Size-for-size copies of the transparency rather than enlarged copies thereof may be optionally formed. In this mode, projector 20 serves as an additional illumination source. Transparency 18 is placed beneath Fresnel lens 36 with composition frame 40 and screen 42 disposed therebeneath. The aperture in frame 40 is desigend to extend in an outwardly direction from the borders of transparency 18. Moreover, a plurality of transparencies may be positioned beneath Fresnel lens 36 with composition frame 40 having a plurality of apertures therein adapted to receive each transparency. Hence, the resultant copy reproduced by the electrophotographic printing machine will comprise one or a plurality of size-for-size transparencies.

As shown in FIG. 1, screen 42 is interposed between composition frame 40 and Fresnel lens 36. Slide projection 20 develops the transparency light image which is reflected in a downwardly direction by mirror 34 to pass through screen 42 so as to be modulated thereby. The combined light image of the transparency and composition frame is reflected by mirror 50 through lens 52 and filter 54 forming a single color light image. This single color light image is reflected by mirror 53 in a downwardly direction onto the charged portion of photoconductive surface 12. Thus, the modulated single color light image irradiates the charged portion of photoconductive surface 12 recording a single color electrostatic latent image thereon. Similarly, the light image of composition frame 40 irradiates the charged portion of photoconductive surface 12 forming an unmodulated light image thereof in registration with the single color electrostatic latent image formed from the modulated light image of the color transparency.

Filter mechanism 46 interposes color filters in the optical light path of lens 44 during the exposure process. The appropriate filter operates on the light rays transmitted through lens 44 to form a light image corresponding to a single color of the transparency.

Lamps 48 are arranged to traverse platen 38 illuminating incremental widths of composition frame 40. Lamps 48 are mounted on a suitable carriage (not shown) which is driven by a cable pulley system (not shown) from the drive motor (not shown) rotating drum 10. As lamp carriage traverses platen 32, another cable pulley system (not shown) moves lens 44 and filter 46 at a correlated speed therewith. Filter assembly 46 is mounted on a suitable bracket extending from lens 44 to move in conjunction therewith.

Preferably, slide projector 20 is a Kodak Carousel 600 projector having an F/3.5 Ektaner C projection lens with light source 22 being a quartz lamp. Fresnel lens 36 is preferably a field lens comprising small, recurring light deflecting elements that will, as an entire unit, achieve a uniform distribution of light over a predetermined area. The gratings or grooves therein are preferably about 200 or more per inch. Fresnel lens 36 converges the diverging light rays from lens 24. Thus, the light rays transmitted through platen 38 are substantially parallel to one another. Other suitable field lenses may be employed in lieu of the Fresnel lens. The light image of the color transparency passes through screen 42. Screen 42 modulates this light image forming a half tone light image. Hence, a modulated light image is combined with the image of composition frame 40 and incremental areas thereof are projected onto photoconductive surface 12 discharging the charge thereon.

With continued reference to FIG. 1, after the electrostatic latent image is recorded on photoconductive surface 12, drum 10 rotates to development station C. At development station C, three individual developer units, generally indicated by the reference numerals 52, 54 and 56, respectively, are arranged to render visible the electrostatic latent image recorded on photoconductive surface 12. Preferably, each of the developer units are of the type generally referred to in the art as "magnetic brush developer units". A typical magnetic brush developer unit employs a magnetizable developer mix which includes carrier granules and heat settable toner particles. In operation, the developer mix is continually brought through a directional flux field forming a chain-like array of fibers extending outwardly from a developer roll. This chain-like array of fibers is frequently termed a brush. The electrostatic latent image recorded on photoconductive surface 12, is rotated into contact with the brush of developer mix. Toner particles are attracted from the carrier granules to the latent image. Each of the developer units contain appropriately colored toner particles. For example, a green filtered light image is developed by depositing magenta toner particles thereon. Similarly, a red filtered light image is developed with cyan toner particles and a blue filtered light image with yellow toner particles. A development system of this type is described in U.S. Pat. No. 3,854,449 issued to Davidson in 1974.

After the single color electrostatic latent image is developed, drum 10 rotates to tranfer station D. At transfer station D, the toner powder image adhering electrostatically to photoconductive surface 12 is transferred to a sheet of support material 58. Support material 58 may be a plain paper or a sheet of plastic material, amongst others. Transfer station D includes corona generating means, indicated generally at 60, and a transfer roll designated generally by the reference numerals 62. Corona generator 60 is excited with an alternating current and arranged to pre-condition the toner powder image adhering electrostatically to photoconductive surface 12. In this manner, the pre-conditioned toner powder image will be more readily transferred from the electrostatic latent image recorded on photoconductive surface 12 to support material 54 secured releasably on transfer roll 62. Transfer roll 62 recirculates support material 58 and is electrically biased to a potential of sufficient magnitude and polarity to attract electrostatically the pre-conditioned toner particles from the latent image recorded on photoconductive surface 12 to support material 58. Transfer roll 62 rotates in the direction of arrow 64, in synchronism with drum 10, to maintain support material 58 secured releasably thereon rotating in registration with the toner powder image developed on photoconductive surface 12. In this way, successive toner powder images may be transferred to support material 58 in superimposed registration with one another. U.S. Pat. No. 3,838,918 issued to Fisher in 1974 discloses a suitable transfer system.

Prior to proceding with the remaining processing stations, the sheet feeding apparatus will be briefly described. Support material 58 is advanced from a stack 66 mounted on a tray 68. Feed roll 70, in operative communication with retard roll 72, advances and separates the uppermost sheet from stack 66. The advancing sheet moves into chute 74 which directs it into the nip between register rolls 76. Register rolls 76 align and forward the sheet to gripper fingers 78 which secure support material 58 releasably on transfer roll 62. After the requisite number of toner powder images have been transferred to support material 58, gripper fingers 78 release support material 58 and space it from transfer roll 62. As transfer roll 62 continues to rotate in the direction of arrow 64, stripper bar 80 is interposed therebetween. In this way, support material 58 passes over stripper bar 80 onto endless belt conveyor 82. Endless belt conveyor 82 advances support material 58 to fixing station E.

At fixing station E, a fuser, indicated generally by the reference numeral 84, generates sufficient heat to permanently affix the multi-layered powder image to support material 58. A suitable fusing device is described in U.S. Pat. No. 3,781,516 issued to Tsilibes et al., in 1973. After the fixing process, support material 58 is advanced by endless belt conveyors 86 and 88 to catch tray 90 permitting the machine operator to remove the finished color copy from the printing machine.

Although a preponderance of the toner particles are transferred to support material 58, invariably some residual toner particles remain adhering to photoconductive surface 12 after the transfer process. These residual toner particles are removed from photoconductive surface 12 at cleaning station F. Cleaning station F includes a corona generating device (not shown) for neutralizing the electrostatic charge remaining on the residual toner particles and photoconductive surface 12. The neutralized toner particles are then cleaned from photoconductive surface 12 by a rotatably mounted fibrous brush 92 in contact therewith. A suitable brush cleaning device is described in U.S. Pat. No. 3,590,412 issued to Gerbasi in 1971.

It is believed that the foregoing description is sufficient for purposes of the present application to illustrate the general operation of the color electrophotographic printing machine incorporating the features of the present invention therein.

Figure 2:
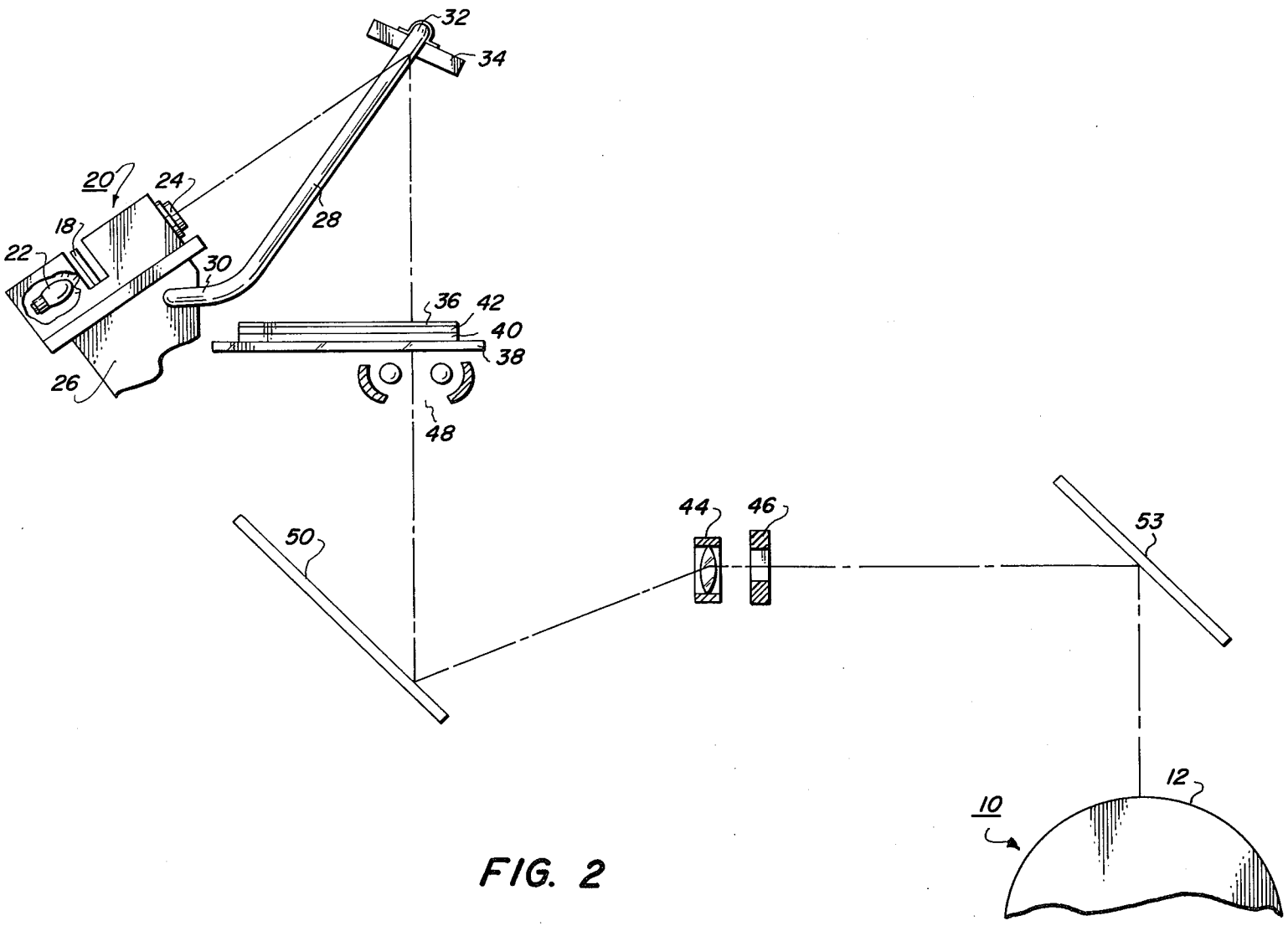
FIG. 2 is a schematic illustration of the FIG. 1 printing machine optical system.

Referring now to FIG. 2, the specific characteristics of the optical system employed in the FIG. 1 printing machine will be discussed. As hereinbefore indicated, projector 20 preferably is a Kodak Carousel 600 projector having an F/3.5 Extaner C projection lens. Light source 22 is a quartz lamp. Projector 20 is mounted on frame 26 of the printing machine. Arm 28 has mirror 34 secured rotatably on end portion 32 thereof. Similarly, end portion 30 of arm 28 is mounted pivotably on frame 26. One suitable configuration for arm 28 is U-shaped. With a configuration of this type, portions 30 and 32 extend substantially normal to the central portion of arm 28. In the transparency reproduction mode, arm 28 is pivoted so as to dispose mirror 34 in the path of the transparency light image. Mirror 34 is rotated on portion 32 of arm 28 so that the light image is reflected in a downwardly direction through Fresnel lens 36, screen 42, composition frame 40 and platen 38. As previously noted, Fresnel lens 30 comprises a plurality of small light deflecting elements that provide a uniform distribution of light over a pre-determined area. Preferably, there are 200 or more gratings per inch. This field lens converges the diverging light rays from lens 24. This insures that the light rays transmitted through platen 38 are substantially parallel. Many other types of field lenses may be employed in lieu of a Fresnel lens, provided they converge the diverging light rays emitted from slide projector 20.

Screen 42 modulates the light image to form a half tone light image. Preferably, screen 42 includes a substantially transparent sheet made from a suitable plastic or glass. A plurality of spaced, opaque dots or lines are printed on the transparent sheet by a suitable chemical etching or photographic technique. The screen may be made from any number of opaque metallic materials suitable for chemical etching which are sufficiently thin to be flexible, such as copper or aluminum. The spacing between adjacent lines or dots determines the quality of the resulting copy. A fine screen size generally results in a more natural or higher quality copy. Hence, while a coarse screen having 50 to 60 lines or dots per inch will be useful for some purposes, finer screens such as those having anywhere from 100 to 400 dots or lines per inch will form a copy of nearly continuous tone. As the screen size becomes finer, the screen pattern will be imperceptable on the finished copy and the copy will have the appearance of a continuous tone photograph. Preferably, a dot screen is positioned on the platen. A suitable line screen will have about 120 lines per inch. Contrawise, a suitable dot screen may include a plurality of equally spaced, soft gray square dots having about 85 dots per inch. However, this may range from about 65 to about 300 dots per inch. The foregoing is only limited by the optical system and the desired resolution. A suitable dot screen for disposition on the platen is manufactured by Caprock Corporation and may be a negative screen. An optical system employing such a screen for reproducing transparencies is described in co-pending application Ser. No. 540,617 filed in 1975.

Lamps 48 traverse platen 38 to illuminate incremental areas of composition frame 40. In this way, the light rays from composition frame 40 and the modulated light image of the transparency are transmitted in a downwardly direction onto mirror 50. Mirror 50 reflects the combined light image through lens 44. Preferably, lens 44 is a six-element split dagor type of lens having front and back compound lens components with a centrally located diaphragm therebetween. Lens 44 forms a high quality image with a field angle of about 31° and a speed ranging from about F/4.5 to about F/8.5 at a 1:1 magnification. In addition, lens 44 is designed to minimize the effect of secondary color in the image plane. The front lens component has three lens elements including, in the following order, a first lens element of positive power, a second lens element of negative power cemented to the first lens element, and a third lens element of positive power disposed between the second lens element and the diaphragm. The back lens component also has three similar lens elements positioned so that lens 44 is symmetrical. Specifically, the first lens element in the front component is a double convex lens, the second element a double concave lens and the third element a convex-concave lens element. For greater details regarding lens 44, reference is made to U.S. Pat. No. 3,592,531 issued to McCrobie in 1971.

The light image transmitted from lens 44 passes through one of the filters in filter mechanism 46. Preferably, filter mechanism 46 includes a housing which is mounted on lens 44 by a suitable bracket and moves with lens 44 during scanning as a single unit. The housing of filter 46 includes a window which is positioned relative to lens 44 permitting the light rays of the combined image, i.e., that of the composition frame and transparency to pass therethrough. Bottom and top walls of the housing include a plurality of tracks which extend the entire width thereof. Each track is adapted to carry a filter to permit movement thereof from an inoperative position to an operative position. In the operative position, the filter is interposed into the window of the housing permitting light rays to pass therethrough. Individual filters are made from any suitable filter material such as coated glass. Preferably, three filters are employed in the electrophotographic printing machine depicted in FIG. 1, a red filter, a blue filter and a green filter. A detailed description of the filter mechanism is found in U.S. Pat. No. 3,775,006 issued to Hartman et al. in 1973.

As previously noted, lamps 48, lens 44, and filter 46 move in synchronism with drum 10. The light image transmitted therethrough is reflected by mirror 53 in a downwardly direction onto the charged portion of photoconductive surface 12. This selectively dissipates the charge thereon to record a single color electrostatic latent image. This single color electrostatic latent image may comprise a modulated electrostatic latent image of the transparency as well as an un-modulated electrostatic latent image of the composition frame.

In recapitulation, the electrophotographic printing machine depicted in FIG. 1 is adapted to reproduce color opaque original documents as well as color transparencies. The foregoing is achieved by pivoting a mirror assembly into and out of the path of the transparency light image. Thus, when an opaque original document is being reproduced, the mirror is pivoted to a position remote from the optical light path of the color transparency image. Contrawise, if a color transparency is being reproduced, the mirror is pivoted into the path of the color transparency light image to direct the light image onto the charged portion of the photoconductive surface. In this way, both color transparencies and opaque original documents may be readily reproduced in the electrophotographic printing machine.

Thus, it is apparent that there has been provided, in accordance with the present invention, an electrophotographic printing machine that fully satisfies the objects, aims and advantages hereinbefore set forth. While this invention has been discussed in conjunction with a specific embodiment thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What is claimed is:

1. An electrophotographic printing machine for reproducing a transparency or an opaque original document, including:

a receiving member;

a photoconductive member;

means for charging at least a portion of said photoconductive member to a substantially uniform level;

means for projecting a light image of the transparency;

means for modulating the light image of the transparency; and means for directing the light image of the transparency through said receiving member and said modulating means onto the charged portion of said photoconductive member selectively dissipating the charge thereon to record an electrostatic latent image thereof, said directing means being movable from a first position remote from the path of the transparency light image wherein the electrophotographic printing machine reproduces the opaque original document to a second position in the path of the transparency light image wherein the electrophotographic printing machine reproduces the transparency.

2. A printing machine as recited in claim 1, further including:

a composition frame disposed on said receiving member; and means for exposing the charged portion of said photoconductive member to a light image of said composition frame recording thereon a combined electrostatic latent image comprising the electrostatic latent image of the transparency and the electrostatic latent image of said composition frame.

3. A printing machine as recited in claim 2, further including means for filtering the light image of the transparency to form a single color light image which irradiates the charged portion of said photoconductive member to record thereon a single color electrostatic latent image.

4. A printing machine as recited in claim 3, wherein said projecting means includes a slide projector arranged to project a light image of the transparency onto said directing means located in the second position.

5. A printing machine as recited in claim 4, wherein said receiving member includes:

a transparent platen member having said composition frame disposed thereon; and a field lens mounted on said composition frame and arranged to converge diverging light rays.

6. A printing machine as recited in claim 5, wherein said modulating means includes a screen interposed between said field lens and said composition frame.

7. A printing machine as recited in claim 6 wherein said directing means includes:

a frame supporting said slide projector;

an arm having one end portion thereof mounted pivotably on said frame; and a mirror mounted rotatably on the other end portion of said arm.

8. A printing machine as recited in claim 7, wherein said exposing means includes:

a light source arranged to illuminate said composition frame disposed on said receiving member; and lens means for receiving the light rays from the combined image of the color transparency and said composition frame.

9. A printing machine as recited in claim 8, wherein said filtering means includes:

a red filter arranged to be interposed into the light image path to transmit a red light image therethrough;

a blue filter arranged to be interposed into the light image path to transmit a blue light image therethrough; and a green filter arranged to be interposed into the light image path to transmit a green light image therethrough.

10. A printing machine as recited in claim 8, wherein said screen includes a plurality of spaced, soft gray square dots.

11. A printing machine as recited in claim 10, wherein said screen preferably includes 85 dots per inch.

12. A printing machine as recited in claim 8, wherein said field lens preferably includes 200 gratings per inch.

13. A printing machine as recited in claim 8, further including:

means for developing the single color electrostatic latent image recorded on said photoconductive member with toner particles complementary in color to the single color light image;

means for transferring the toner powder image adhering to the electrostatic latent image recorded on said photoconductive member to a sheet of support material; and means for permanently affixing the toner powder image to the sheet of support material.

* * * * *